US006152042A

United States Patent [19]

Barry et al.

[11] Patent Number: 6,152,042

[45] Date of Patent: Nov. 28, 2000

[54] RAILCAR RETARDER ASSEMBLY

[75] Inventors: Robert C. Barry, West Chester, Pa.; Daniel A. Ivanyo, Merrillville, Ind.

[73] Assignee: ABC Rail Products Corporation, Chicago, Ill.

[21] Appl. No.: 09/206,357

[22] Filed: Dec. 7, 1998

[51] Int. Cl.[7] ..... B61K 7/02

[52] U.S. Cl. ..... 104/26.2; 104/249; 104/252; 104/258; 104/259; 188/38

[58] Field of Search ..... 104/26.2, 249, 104/252, 258, 259; 188/38, 62, 63

[56] References Cited

U.S. PATENT DOCUMENTS 1,618,535 2/1927 Jordan ..... 104/26.2
1,831,802 11/1931 Bone ..... 104/26.2
3,253,142 5/1966 Brown ..... 104/26.2
3,621,942 11/1971 Sten ..... 188/62
3,946,973 3/1976 Budway et al. ..... 246/182 BH

*Primary Examiner*—S. Joseph Morano
*Assistant Examiner*—Frantz Jules
*Attorney, Agent, or Firm*—Thomas S. Baker, Jr.

[57] ABSTRACT

A railcar retarder assembly for use in a railroad trackwork such as a railcar classification yard is provided with a fixed base plate, a vertically-oriented pivot shaft secured to the base plate, an elongated and curved cam member mounted on the pivot shaft, and a horizontally-oriented hydraulic subsystem piston element that induces reaction hydraulic damping forces which are transmitted horizontally to the wheel flanges of a passing railcar to thereby reduce the rolling velocity of the railcar.

9 Claims, 2 Drawing Sheets

RAILCAR RETARDER ASSEMBLY

BACKGROUND OF THE INVENTION

It is a wide-spread practice in the United States to provide railroad system railcar classification or marshalling yards with retarders that function to control the velocity of free-rolling railcars that are being classified and directed to various different tracks for routing to different destinations. Most such classification yards over the years have utilized retarder equipment falling into one of two basically different types.

Certain known train marshalling yards have utilized conventional mechanical retarders having movable metal surfaces, usually spring-urged, that press the faces of railcar wheel flanges passing through the retarders against the vertical faces of the adjacent supporting trackwork rails to create friction forces that reduce the railcar's free-rolling velocity. While such mechanical railcar retarders have substantial braking power and are of relatively simple design, their metal-to-metal braking contact is extremely noisy and causes substantial metal wear. Examples of such mechanical railcar retarders are disclosed in U.S. Pat. No. 1,452,556 issued in the name of Hackworth et al. and in U.S. Pat. No. 5,388,525 granted to Bodkin.

Other known railcar classification or marshalling yards have utilized conventional hydraulic retarders that basically utilize the weight of passing-through railcars to induce a hydraulic fluid damping that functions to reduce railcar rolling velocity. Typically the rim of a wheel flange engages the hydraulic actuator. Such hydraulic retarders have minimal metal-to-metal sliding friction surfaces thereby resulting in a significant reduction or equipment operating noise and also a significantly reduced extent of metal surface wear. However, such prior art hydraulic railcar retarders have substantial disadvantages in that the amount of railcar rolling energy that can be absorbed by their weight-induced fluid damping is comparatively limited, that there is a tendency for light-weight railcars to "jump" or "bounce" when rolling over the conventional retarder weight-actuated hydraulics element preset for heavier railcars and hence not be appreciably retarded, and also that there is an inability to control braking forces to achieve a predetermined and variable railcar retarded rolling velocity. In addition, current designs operate at a singular point, thereby concentrating their action within a very short and abrupt time period, further contributing toward the tendency for railcars to jump when rolling over the retarder.

We have discovered that the shortcomings of both known types of railcar retarder equipment can be overcome by utilizing a novel hydraulic railcar retarder assembly that is not activated by railcar weight but yet effectively reduces the momentum of railcars passing therethrough. This invention utilizes the railcar's momentum to activate the hydraulic railcar retarder. It also operates over a distributed area, thereby reducing the abruptness of braking forces so as to reduce the tendency of railcars to jump out of the retarder.

Other objects and advantages of the present invention will become apparent during consideration of the detailed descriptions, drawings, and claims which follow.

SUMMARY OF THE INVENTION

The railcar retarder assembly of the present invention is essentially comprised of a base plate, a pair of opposed skate elements that are pivotally mounted on the base plate and that each have laterally-rotated and curved camming surfaces, and a hydraulics subassembly mounted on the base plate and having opposed piston elements that co-operate with the camming surfaces of the opposed pivoted skates. The assembly base plate is secured to conventional railroad crossties and in a fixed spatial relation to the railroad trackwork rails that support the flanged wheels of the railcar that is to be retarded.

Although some friction is generated as between railcar wheel flange surfaces, supporting trackwork rails, and the reactively and laterally-rotated skate element during railcar retardation, such is minimal or almost insignificant in comparison to the magnitude of the braking force applied to the railcar wheel flanges as a consequence of hydraulic fluid damping in the retarder hydraulics subsystem.

DETAILED DESCRIPTION

Figure 1:
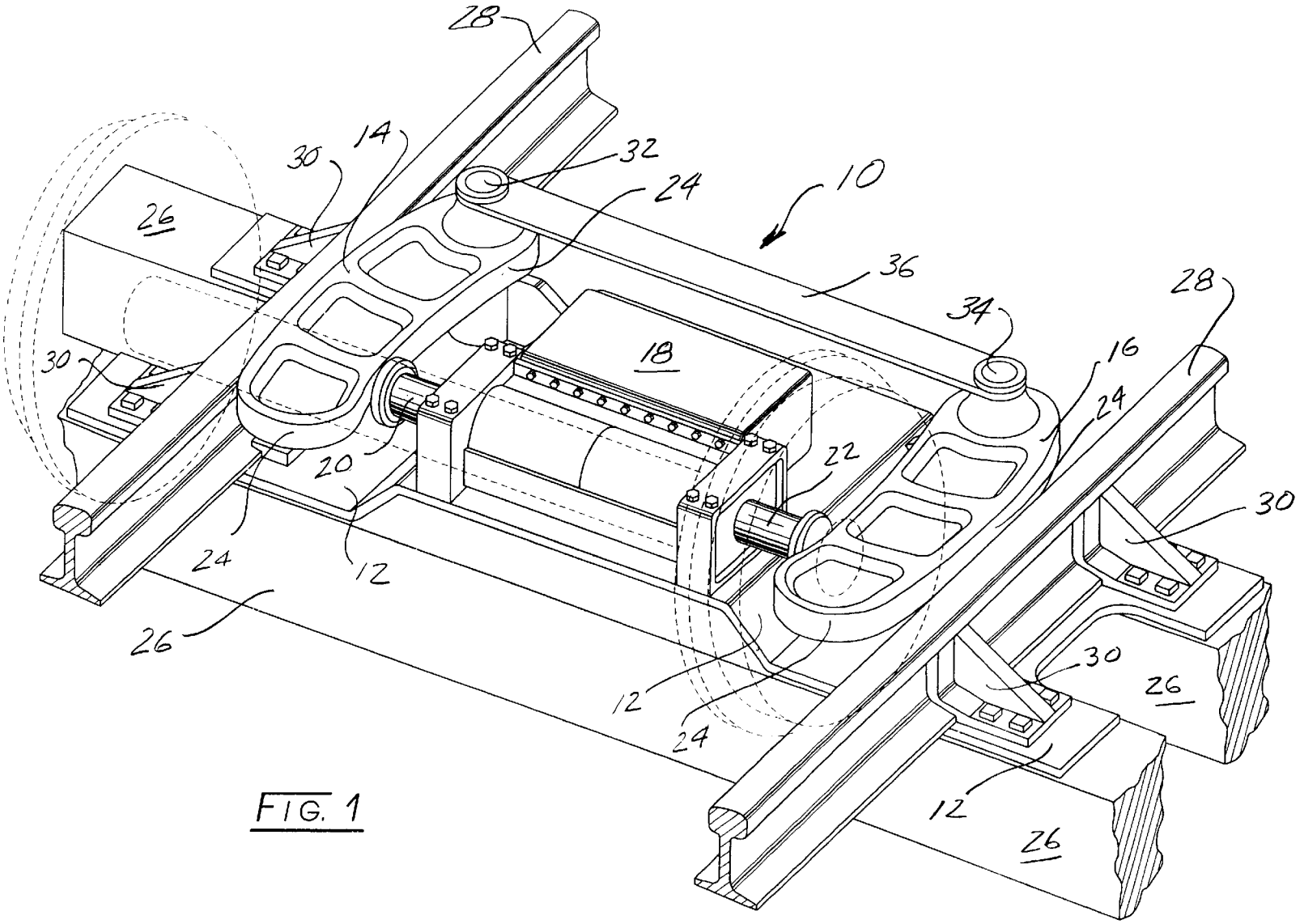
FIG. 1 is an isometric view of a preferred embodiment of the hydraulic railcar retarder of the present invention.

In FIG. 1 of the drawings we illustrate a preferred embodiment of the hydraulic railcar retarder assembly of the present invention, such being identified generally by the reference numeral 10. Assembly 10 is basically comprised of a rigid metal base plate 12, opposed and pivoted actuator elements 14 and 16 secured to the base plate, and a hydraulics subassembly 18 also secured to the base plate and having opposed piston elements 20 and 22 each of which slidably engages a vertical camming surface 24 of its respective actuator element 14 or 16.

Assembly 10 is mounted on conventional railroad trackwork crossties 26 along with conventional trackwork rails 28 by conventional bolted mounting braces 30. Normally assembly 10 is constructed and positioned within trackwork rails 28 in a manner whereby the outermost vertical camming surfaces 24 of actuator elements 14 and 16 just touch the inner vertical surface of their respective trackwork rail 28. Also, the vertical shafts 32 and 34 that pivotally support actuator elements 14 and 16 are preferably cross-braced in a conventional manner by a rigid tie rod designated 36. Channels and/or brackets are designed into the base plate to provide a nominal track gage reference for the installation.

Figure 2:
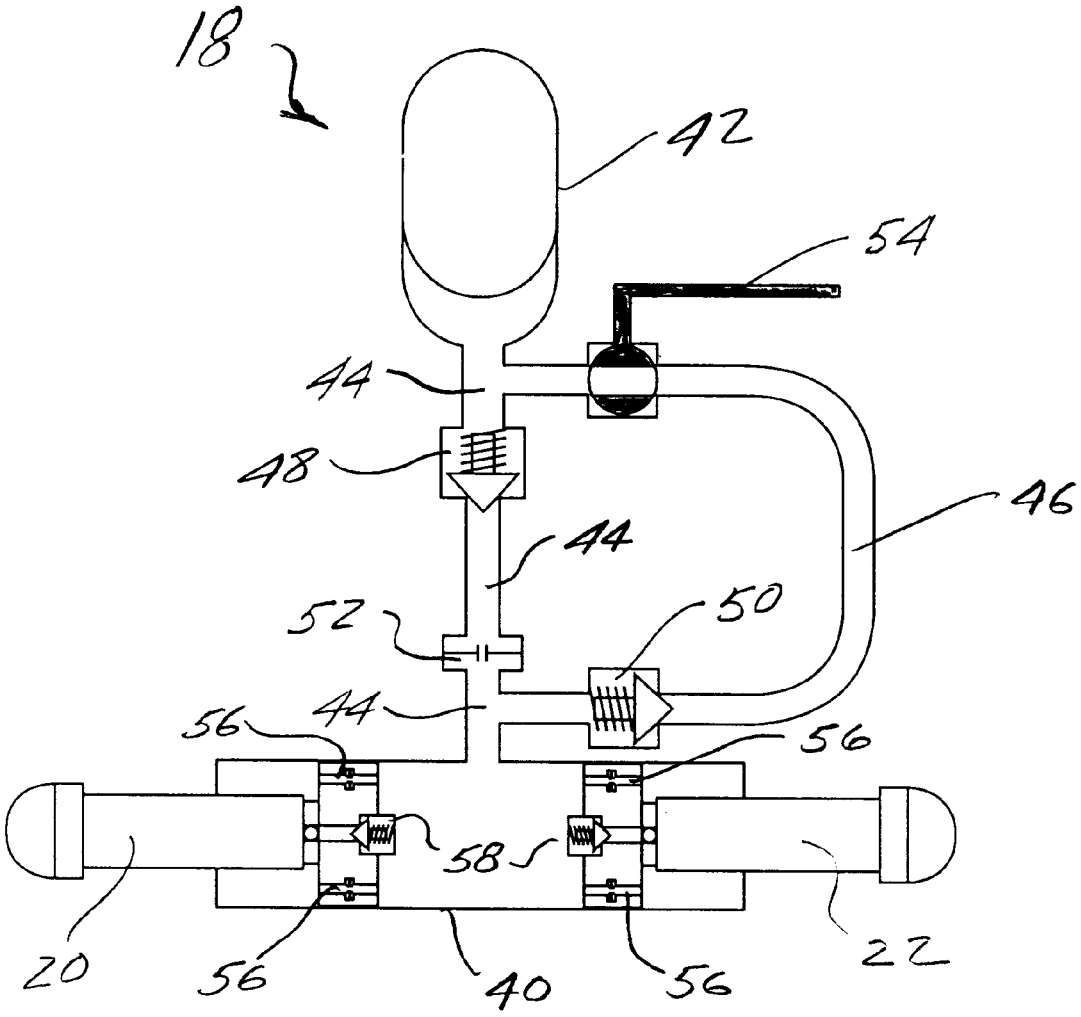
FIG. 2 is a schematic diagram of the hydraulics subsystem included in the railcar retarder assembly of FIG. 1.

Additional details regarding hydraulics subassembly 18 are provided schematically in FIG. 2 of the drawings. Such subassembly, in addition to including piston elements 22 and 24, is comprised of a conventional hydraulic cylinder element 40, a co-operating conventional gas-filled accumulator element 42, and interconnected hydraulic fluid flow line or passageway elements 44 and 46. Also preferably included in hydraulics subassembly 18 fluid flow lines (passageways) 44 and 46 are the illustrated and conventional check valve elements 48 and 50, adjustable hydraulic fluid flow restrictor (orifice) element 52, ball valve element 54, and necessary hydraulic fluid. If desired, a conventional velocity-sensitive, fluid flow valve element having selectable variable flow sensitivity may be substituted for fluid flow restrictor (orifice) element 52. (It should be noted that conventional gas-filled accumulator element 42 may be replaced by a functionally-equivalent, combined compression spring and co-operating hydraulic actuator).

To effect the desired compression and return movements of piston elements 20 and 22 and their externally projecting integral piston rods we provide each such piston element with the illustrated internal restrictor passageways 56 and also with the internal check valve passageways 58. During operation of retarder assembly 10 check valve passageways 58 are closed during inward movement of pistons 22 and 24 thus forcing hydraulic fluid pressurized by and trapped between such pistons to be flowed principally through passageways 44, variable restrictor 52, and check valve 48 to gas-filled accumulator element 42 thereby continuously increasing the accumulator internal pressure and the quantity of rail car wheel flange energy being absorbed. Variable restrictor 52 sets the flowrate of fluid through hydraulics subsystem 18.

After a railcar wheel flange passes through retarder assembly 10 the pressurized gas in accumulator element 42 expands in volume and causes hydraulic fluid to return to cylinder element 40 via ball valve 54, if open, and check valve element 50. The so-flowed and pressurized hydraulic fluid causes piston internal check valve passageways 58 to be closed and piston elements 20 and 22 to be moved rapidly in outward directions. The continuous contact of externally-projecting integral piston rod portions of piston element 20 and 22 with camming surfaces 24 causes actuator elements 14 and 16 to be rapidly rotated to their initial position.

As noted previously inward reactive linear movement of piston elements 22 and 24 resulting from the inward pivoting of co-operating actuator elements 14 and 16 and their integral camming surfaces 24 by assembly contact with passing railcar wheel flanges results in the flow of hydraulic fluid from within cylinder 40, through passageways 44, and through elements 48 and 52 to cause the gas in accumulator element 42 to become momentarily highly compressed. The rolling velocity of the passing railcar is reduced by the application of retarding forces over time in an amount that corresponds to the energy absorbed by retarder assembly 10. After the passing railcar wheel moves out of contact with railcar retarder assembly 10, the compressed gas of accumulator element 42 will return piston elements 20 and 22 to their initial positions. Ball valve 54 may be selectively closed to prevent assembly 10 from functioning after the first railcar wheel flange has passed through.

In one actual embodiment of the present invention the hydraulics subsystem operating characteristics included a piston element operating stroke of 4 inches for each piston, a maximum piston stroke velocity of 40 inches per second, a minimum time to perform a piston stroke of 0.1 second, and a 3,000 pounds per square inch accumulator operating pressure.

Generally, the prior art type of hydraulic railcar retarder is capable of absorbing about 700 foot-pounds of energy per railcar wheel and wheel-caused piston stroke. The railcar retarder assembly of the present invention, on the other hand, typically absorbs to as much as approximately 30,000 foot-pounds of railcar rolling velocity energy per set of opposed railcar wheels and the wheel-caused piston strokes.

It should be noted that the metal-to-metal contacts which exist as between co-operating conventional railcar rail and conventional railcar wheel flanges, and as between conventional railcar wheel flanges and actuator camming surface elements, that result from the operation of hydraulic retarder assembly 10 are essentially only spot or line contacts and not substantial surface area-to-surface area contacts. Rather than relying upon surface-generated friction or weight-induced hydraulic damping to generate the forces that lessen railcar velocity during free-rolling, the present invention applies the substantial forces developed by the hydraulic damping of hydraulics subassembly 18 and piston elements 20 and 22 only horizontally to passing railcar wheels to effect a reduction of railcar rolling velocity.

Although the drawings focus on the construction details of a single railcar retarder assembly 10, a railroad classification yard railcar retarder installation utilizing the present invention is typically comprised of a series of railcar retarder assemblies 10 positioned in spaced-apart relation along the trackwork rails that support the passing railcars. Such multiple retarder assembly installations may optionally incorporate any one of several different hydraulic fluid flow restriction schemes. In one version the energy-absorbing hydraulics subassemblies may be combined to function with a single orifice-like hydraulic fluid flow restrictor 52 or a single, functionally equivalent flow velocity-sensitive valve having selectable variable flow sensitivity. Alternatively, the multiple retarder assembly installation of successive spaced-apart assemblies 10 may have their individual energy-absorbing hydraulic subassemblies 18 incorporate hydraulic fluid flow restrictor elements (orifice-type or flow-sensitive valve-type) with successively different fluid flow restriction settings.

Various changes in size, shape, and materials of construction may be made to the disclosed railcar retarder assembly invention without departing from the scope, meaning, or intent of the claims which follow.

We claim as our invention:

1. A railcar retarder assembly for co-operation with a railroad trackwork railcar rail and with a rail-supported railcar, and comprising:

a base plate for mounting in a fixed position relative to the railroad trackwork railcar rail;

a vertically-oriented pivot shaft rigidly secured to said base plate;

a retarder actuator pivotally mounted on said pivot shaft, having a curved camming surface that is positioned adjacent the railroad trackwork railcar rail, and that is rotated in a horizontal plane when moved by the wheel flange of the railcar passing through the assembly; and an energy-absorbing hydraulics subassembly co-operatively connected to said actuator, and comprising a hydraulic fluid-containing hydraulic cylinder element, a reciprocable piston element positioned within said hydraulic cylinder element and having a connected piston rod extending horizontally outside, a gas-filled accumulator element, and fluid line means for flowing hydraulic fluid as between said hydraulic cylinder element and said gas-filled accumulator element, said reciprocable piston element and connected piston rod having longitudinal axes that are oriented horizontally and at right angles to the longitudinal axis of the railroad trackwork railcar rails and have continuous contact with said assembly actuator curved camming surface, said energy-absorbing hydraulics subassembly absorbing energy from said actuator when the wheel flange of the railcar passing through the assembly rotates said actuator horizontally in one direction, and rapidly rotating said actuator horizontally in an opposite direction after the wheel flange of said railcar passes through the retarder assembly.

2. The railcar retarder assembly invention defined by claim 1 wherein said piston element includes an integral check valve passageway and at least one integral restrictor passageway, said check valve and restrictor passageways enabling said piston element to rapidly rotate said actuator horizontally after the wheel flange of said railcar has passed through the railcar retarder assembly.

3. The railcar retarder assembly invention defined by claim 2 wherein said fluid line means includes a return fluid loop having a first check valve means functioning to permit the flow hydraulic fluid only from said gas-filled accumulator element to said hydraulic cylinder element, and a restrictor element and co-operating second check valve means functioning to permit the flow hydraulic fluid only from said hydraulic cylinder element to said gas-filled accumulator element, said restrictor element being located intermediate said return fluid loop and said gas-filled accumulator element.

4. The railcar retarder assembly defined by claim 3 wherein said fluid line means return fluid loop further comprises a selectively operable valve means which may be actuated between open and closed conditions, said fluid line means selectively operable valve means when actuated to its closed condition causing the continuous stopping hydraulic fluid flow between said gas-filled accumulator and said hydraulic cylinder element after the first railcar wheel flange has passed through the railcar retarder assembly.

5. A railcar retarder assembly for co-operation with oppositely-spaced railroad trackwork railcar rails and with a rail-supported railcar, and comprising:

a base plate for mounting in a fixed position relative to the railroad trackwork railcar rails;

a pair of spaced-apart and vertically-oriented pivot shafts rigidly secured to said base plate;

a pair of actuator members respectively pivotally mounted on said pivot shafts, each of which has a curved camming surface that is movable horizontally, and that each of which is rotated in a horizontal plane when moved by a wheel flange of a railcar passing through the assembly, and positioned adjacent the railroad trackwork rails; and an energy-absorbing hydraulics subassembly co-operatively connected to said pair of actuators and comprising a hydraulic fluid-containing hydraulic cylinder element, a pair of reciprocable piston elements positioned within said hydraulic cylinder element and each having a connected piston rod extending horizontally outside, a gas-filled accumulator element, and fluid line means for flowing hydraulic fluid as between said hydraulic cylinder element and said gas-filled accumulator element, said reciprocable piston elements and connected piston rods having longitudinal axes that are oriented horizontally and at right angles to the longitudinal axis of the railroad trackwork railcar rails and having continuous contact with said assembly actuators, said energy-absorbing hydraulics subassembly absorbing energy from said pair of actuators when opposed wheel flanges of the railcar passing through the assembly rotates each actuator of said pair of actuators horizontally in an inward direction, and rapidly rotating each actuator of said pair of actuators horizontally in an outward direction after the opposed wheel flanges of said railcar passes through the assembly.

6. The railcar retarder assembly invention defined by claim 5 wherein each piston element of said pair of reciprocable piston elements includes an integral check valve passageway and at least one integral restrictor passageway, said check valve and restrictor passageways enabling said pair of reciprocable piston elements to rapidly rotate said cam members horizontally after the wheel flange of the railcar has passed through the railcar retarder assembly.

7. The railcar retarder assembly invention defined by claim 5 wherein said fluid line means includes a return fluid loop with first check valve means functioning to permit the flow hydraulic fluid only from said gas-filled accumulator element to said hydraulic cylinder element, and a restrictor element and co-operating second check valve means functioning to permit the flow hydraulic fluid only from said hydraulic cylinder element to said gas-filled accumulator element, said restrictor element being functionally located intermediate said return fluid loop and said gas-filled accumulator element.

8. The railcar retarder assembly defined by claim 7 wherein said fluid line means return fluid loop further comprises a selectively operable valve means which may be actuated between open and closed conditions, said fluid line means fluid loop selectively operable valve means when actuated to its closed condition and said restrictor means together continuously stopping the flow of hydraulic fluid between said gas-filled accumulator and said hydraulic cylinder element after the first railcar wheel flange has passed through the railcar retarder assembly.

9. In a method of reducing the velocity of a free-rolling railroad system railcar having wheels with flanges and supported on a trackwork rail, the steps of transferring railcar wheel forces horizontally to a rotatable curved camming surface, rotating the curved camming surface about a vertical axis, and causing the rotated curved camming surface to horizontally move a reversible hydraulic piston that compresses gaseous fluid to a high degree of compression and that by hydraulic fluid damping creates a high magnitude reaction force, said high magnitude reaction force being applied horizontally by the reversible hydraulic piston and the rotatable curved camming surface to railcar wheel flanges to thereby oppose said railcar wheel rolling resistance forces and reduce the rolling velocity of a passing free-rolling railroad system railcar.

* * * * *